US006184191B1

(12) United States Patent
Wolfersberger

(10) Patent No.: US 6,184,191 B1
(45) **Date of Patent: *Feb. 6, 2001**

(54) TRANSPARENT SOAP WITH PRINTED LOGO

(76) Inventor: Donna J. Wolfersberger, 5612 Summerside Trail, St. Louis, MO (US) 63128

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/158,700

(22) Filed: Sep. 22, 1998

Related U.S. Application Data

(63) Continuation-in-part of application No. 08/739,462, filed on Oct. 29, 1996, now Pat. No. 5,869,437.

(51) Int. Cl.[7] ..... C11D 17/00; C11D 17/04; C11D 9/00

(52) U.S. Cl. ..... 510/147; 510/143; 510/440; 510/483

(58) Field of Search ..... 510/147, 130, 510/133, 139, 141, 143, 144, 440; 252/FOR 117

(56) References Cited

U.S. PATENT DOCUMENTS

| | | | | |
|---|---|---|---|---|
| Re. 6,624 | * | 8/1875 | Strunz | 510/147 |
| 165,628 | * | 7/1875 | Strunz | 510/147 |
| 710,939 | * | 10/1902 | Berry . | |
| 1,441,315 | * | 1/1923 | Walbridge . | |
| 1,636,709 | * | 7/1927 | Schmidt | 510/147 |
| 1,827,549 | * | 10/1931 | Villain | 510/147 |
| 1,983,002 | * | 12/1934 | Reeves . | |
| 3,149,188 | * | 9/1964 | Schmitt | 264/267 |
| 3,413,230 | * | 11/1968 | Dupuis | 252/92 |
| 3,969,259 | * | 7/1976 | Lages | 252/107 |
| 4,297,228 | * | 10/1981 | Kamada et al. | 252/92 |
| 4,504,433 | * | 3/1985 | Inui et al. | 264/232 |
| 5,472,545 | * | 12/1995 | Malki | 156/252 |
| 5,492,644 | * | 2/1996 | Minkin | 252/134 |
| 5,529,714 | * | 6/1996 | Tokosh | 252/108 |
| 5,869,437 | * | 2/1999 | Wolfersberger | 510/147 |

FOREIGN PATENT DOCUMENTS

| | | | | |
|---|---|---|---|---|
| 17950 | * | 2/1930 | (AU) | 252/FOR 117 |
| 584830 | * | 10/1959 | (CA) | 252/FOR 117 |
| 12945 | * | 9/1901 | (GB) | 252/FOR 117 |
| 3763 | * | 11/1905 | (GB) | 252/FOR 117 |
| 304801 | * | 1/1929 | (GB) | 252/FOR 117 |
| 787354 | * | 12/1957 | (GB) | 252/FOR 117 |
| 61-76600 | * | 4/1986 | (JP) | 252/FOR 117 |
| 63-234098 | * | 9/1988 | (JP) | 252/FOR 117 |
| 2-123198 | * | 5/1990 | (JP) | 252/FOR 117 |

* cited by examiner

*Primary Examiner*—Yogendra Gupta
*Assistant Examiner*—John M Petruncio
(74) *Attorney, Agent, or Firm*—Polster, Leider, Woodruff & Lucchesi, L.C.

(57) ABSTRACT

A transparent cleansing bar having a logo or other design or message printed on a non-supporting sheet positioned at approximately the mid-point of the bar. The message is printed on one or both sides of a thin, clear, colorless sheet of synthetic polymer material. The bar is formed from transparent modified soap material. The message is viewable through the transparent bar. An improved method for forming the transparent cleansing bar with a printable film also is disclosed.

3 Claims, 2 Drawing Sheets

TRANSPARENT SOAP WITH PRINTED LOGO

CROSS-REFERENCE TO RELATED APPLICATIONS

This application is a continuation-in-part of application Ser. No. 08/739,462, filed Oct. 29, 1996, now U.S. Pat. No. 5,869,437.

STATEMENT REGARDING FEDERALLY SPONSORED RESEARCH OR DEVELOPMENT

Not Applicable.

BACKGROUND OF THE INVENTION

This invention relates generally to bar soaps and more particularly, to a transparent bar skin cleanser bearing an internal, printed logo that can be offered as decorative soap, an advertising premium, or a novelty.

Bar soaps are well known to the art. Traditional soaps are salts of fatty acids prepared mainly by reacting fats with caustic alkali through a process known as saponification. The treatment of fat with alkali to make traditional soap has been practiced for at least 5000 years.

Conventional toilet bar soaps use higher quality fats and the water content is reduced. Warm molten soap, including perfumes and other additives, is made into flakes and then milled. The milled flakes pass to a plodding machine which works the flakes and compacts the worked soap into bar form. The bars then are cut and stamped to their final shape.

Other modified soaps can be formed into a bar shape and commonly referred to as "soap" by consumers, even though they are not formed totally from fat and alkali through the traditional saponification process. One such common product is Neutrogena® Soap (Neutrogena Corp.), which is a transparent, nondetergent modified bar soap including triethanolamine, stearic acid, tallow, glycerin, coconut oil, castor oil, sodium hydroxide, oleic acid and cocamide DEA. Another is Basis™ Glycerin Soap (Beiersdorf), which is a transparent modified bar soap including tallow, coconut oil and glycerin. These products generally are indicated for people with sensitive, dry or irritated skin who may not tolerate common soap products.

Besides functioning primarily as cleansers, bar soaps, both conventional and modified, generally are provided in aesthetically pleasing forms. The products include perfumes and fragrances and usually are provided in attractive packaging. Often, the bar soaps are impressed with designs so as to render them decorative or aesthetically pleasing. Moreover, the soap bars often serve as advertising vehicles for their manufacturers. The manufacturer's name and trademarks generally are printed directly on the wrap and packaging. Furthermore, the manufacturer includes the trademark or company name on the soap bar itself. That is, most commonly, the name of the soap or company is molded or stamped into the bar of soap. This molding or stamping of the company or product name into the product serves as a source of company and product advertising at least until use of the soap bar under normal bathing or washing conditions wears the company and product name from the soap bar.

Further, the desire to have a company name or product name affixed to a soap bar is not limited to the manufacturer of the soap. For example, large hotel and motel chains provide complimentary soap in their rooms, the soap having the name or the hotel chain stamped or molded into the surface of the bar soap. Other concerns, such as trendy restaurants, gambling casinos and amusement parks have been known to offer such decorated or labeled bar soap for sale in gift shops as premium souvenirs. Thus, there is an incentive to provide a high quality, resilient printed or decorated bar soap with a relatively long-lasting design.

Prior art patents have addressed the desire to decorate, emboss or label soap. For example, U.S. Pat. No. 165,628, to Strunz, provides for transparent soap having a business card or other advertising medium to form a business card made of soap; U.S. Pat. No. 648,247, to Dunne, provides a soap cake having a center core made of insoluble material in two hollow sections that can be placed together to form a container or holder for advertising or other matter; U.S. Pat. No. 1,441,315, to Walbridge, provides a cake of soap having cavo-convex halves with an inscription inside; U.S. Pat. No. 1,764,009. to Embree, shows a soap bar with an inserted card for advertisement and to add reinforcement to the bar; U.S. Pat. No. 1,827,549, to Villain, discloses a transparent soap having cardboard, metal or paper piece at the middle; U.S. Pat. No. 2,051,625 provides an advertising soap; U.S. Pat. No. 3,149,188, to Schmitt, shows imprinted soap; U.S. Pat. No. 3,413,230, to Dupuis, shows a floating soap cake with included educational features; U.S. Pat. No. 3,432,325, to Haba, discloses a process for printing on soap; U.S. Pat. No. 3,432,325, to Baba, provides a process for printing on soap; U.S. Pat. No. 4,078,482, to Goerig et al., discloses a method of embossing an indicia on soap with an elastomeric coated printing head. Further, U.S. Pat. No. 4,297,228, to Kamada et al., teaches a soap with a decorated surface and a method for decorating the soap; U.S. Pat. No. 4,504,433, to Inui et al, provides a process for making a soap bar containing dried soap figures; and U.S. Pat. No. 5,472,545, to Maiki, provides a method for affixing labels to soap bars.

Other prior art patents simply teach the use of some reinforcing or buoyant inserts not particularly adapted to use as an advertising medium. Representative patents include U.S. Pat. Nos. 1,707,334; 3,773,672; 4,438,010; Canadian Patent No. 835913; and British Patent No. 881,767.

The conventional methods for labeling bars of soap all suffer from several drawbacks. First, conventional stamping, embossing or molding results in a superficial decoration formed in the soap which quickly deteriorates or wastes as the soap is used. Moreover, this type of decoration is limited. The design or lettering either is cut or stamped into the soap or consists of raised soap material. Thus, the design necessarily is of the same color and texture as the soap. This type of embossing or etching does not allow for the use of varied, unique, colored or stylized print or design. Presently, with the value of recognizable trademarks and logos advertisers seek a high quality representation of their trademarks, including logo designs and colors.

Although some of the prior art methods are an attempt at forming a long lasting design, if the soap is used for its intended purposes, the designs will deteriorate before the bar of soap is used up. The prior art soaps that include an insert employ an insert having a substantial thickness that supports the bar itself. Several of the prior art designs include a substantial insert for that purpose, i.e. to support the bar until it is used up. However, such supporting inserts, whether plain or bearing a message, create disposal problems and, perhaps even present safety concerns.

The old methods of printing advertisements or trademarks and the like on paper or cardboard and molding the printed paper into the soap suffers from obvious disadvantages. The paper or cardboard medium on which the message or design is printed is detectable through the soap and hence detracts from the aesthetic appeal of the printed message as well as the soap. Furthermore, as the soap bar is used up, the printed paper is exposed to water and the printed message is defaced, becomes unsightly, can leach through the soap and eventually is destroyed. The printed paper presents an obvious disposal or waste problem. Wet paper or cardboard can clog drains and cause other disposal problems.

One attempt to provide a bar of soap bearing a design or printing that remains intact and readable until the bar of soap is used up is a bar soap having an imbedded, printed logo called "To Be", distributed by Dong Won Chemics, South Korea. The "To Be" soap is a dark amber, transparent bar having an embedded, printed message.

BRIEF SUMMARY OF THE INVENTION

It is among the principal objects of the present invention to provide a cleansing bar which includes a printed design that lasts and is readable and viewable nearly as long as the bar.

Another object of the invention is to provide such a cleansing bar that has a printed design within the bar so that the design lasts and is readable and viewable even as the surface of the bar deteriorates or wastes due to use.

Still another object of the invention is to provide such a cleansing bar that is transparent to allow the embedded design to be read or viewed through the bar.

Another object of the invention is to provide such a cleansing bar that has a message printed on a transparent medium which allows the viewing of the printed design, and not the medium, through the bar.

Yet another object of one embodiment of the invention is to provide the design on a dissolvable material embedded in the transparent cleansing bar so that the design dissolves upon exposure to moisture when the bar is nearly used up so as to not create a disposal problem.

Another object of another embodiment the invention is to provide the design on a printable, non-dissolvable material that will allow the printing of a broad array of designs in color but is thin, non-supportive and does not present safety concerns.

Still another object of the invention is to provide a transparent cleansing bar having logo printed on plastic material embedded in the bar that can be used as a decorative soap, an advertising promotion or a novelty.

A still further object of the invention is to provide an improved method for making the aforestated transparent cleansing bar with transparent, printable logo therein.

In accordance with the invention, a transparent cleansing bar having a logo or other design printed on a plastic material embedded at approximately the mid-point of the bar is provided. The logo or design can be printed on one or both sides of a very thin sheet of plastic material. The bar is formed from transparent modified soap material in two halves. The printed sheet is placed between the two halves of the bar and then the halves are fused by pressure and heat to form the transparent bar having the printed logo or design at the midpoint. The logo or design is viewable through the transparent bar.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
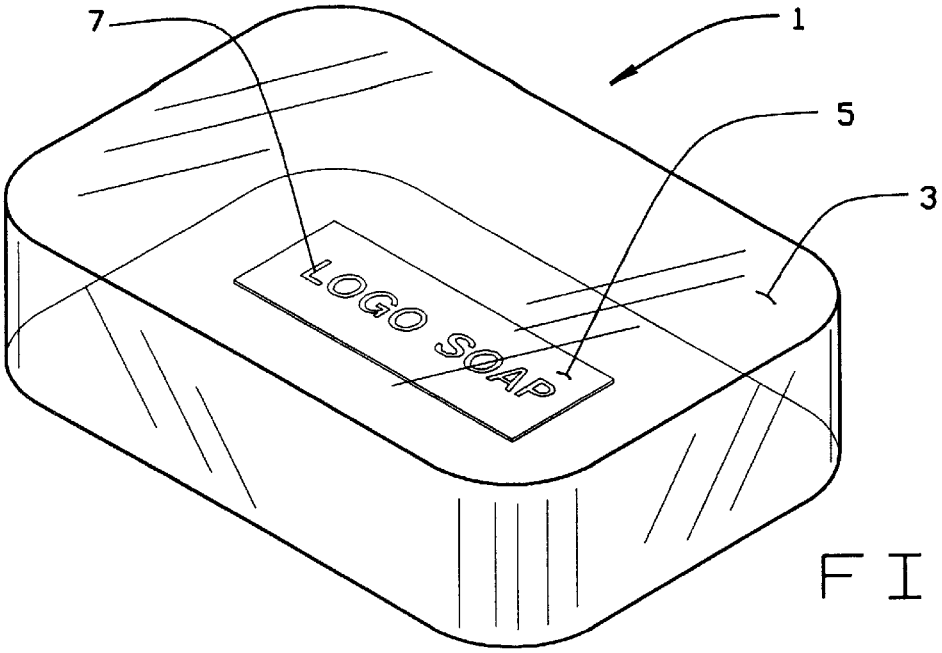
FIG. 1 is perspective view of the novel cleansing bar with a, printed logo embedded therein.
Figure 2:
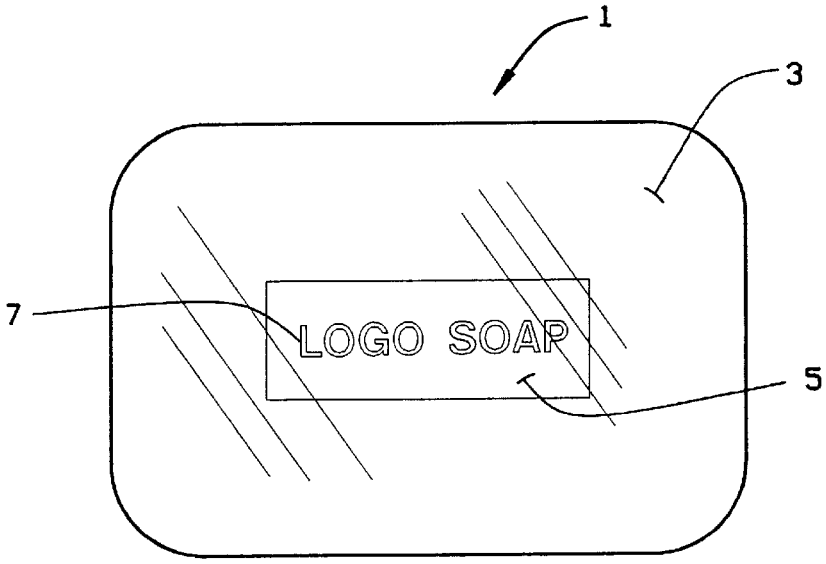
FIG. 2 is a top plan thereof.
Figure 3:
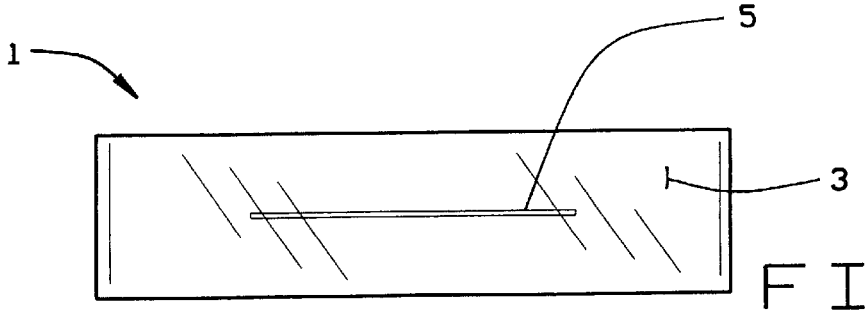
FIG. 3 is an end plan thereof.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

A transparent cleansing bar bearing a printed logo made in accordance with the principles of the present invention is indicated generally in the drawings by reference numeral 1. Bar 1 includes the transparent bar 3 and the printed sheet 5, both of which will be described in greater detail hereinafter. In one embodiment the printed sheet is dissolvable in hot or cold water in another embodiment the sheet is not readily dissolvable.

Bar 1 is shown in the drawings as having an elongated conventional soap bar configuration. It will be appreciated, however, that bar 1 can be a cake of any desired configuration. That is, the cake can be formed or molded having a round or disc-shaped configuration or any other decorative or aesthetically pleasing shape or design such as a flower, shell, bird, animal or so on, without departing from the scope of the invention. It also will be appreciated that bar cleanser 1, whatever the configuration, can be referred to as a soap bar or soap cake.

Bar 1 is formulated to be transparent. The constituents of bar 1, when mixed as described below and molded into the desired configuration, is remarkably clear allowing light to pass through it. Furthermore, the formula set out below is one representative formula which produces a soap product having a desired clarity. However, any other formulation of constituents that will produce a clear bar product that allows an undistorted view of a printed logo at the midpoint of the bar is acceptable and is intended to be included within the scope of the invention.

As set out above, the clarity of the bar is such that printed sheet 5 positioned at approximately the midpoint of bar 3 can be read without distortion of the printed message. The bar 3 may have a slight tint, such as a pale pastel coloring, i.e., pink, blue, amber and so on, but will retain its substantially clear "see-through" properties. One acceptable formulation used to produce bar 3 is prepared by following the procedure of Example 1:

EXAMPLE 1

| | | |
|---|---|---|
| Step A | Propylene Glycol | 25.00% |
| | Sorbitol 70% | 25.75% |
| | Sodium Laureth Sulfate | 17.50% |
| Step B | Stearic Acid | 13.00% |
| | Myristic Acid | 6.00% |
| Step C | Caustic Soda 50% | 6.00% |
| Step D | Sodium Cocoyl Isethionate | 5.00% |
| | Triethanolamine | 1.00% |
| Step E | Fragrance | 0.75% |

1. Add the ingredients of Step A to a mixing vessel. Begin heating and mixing.

2. Add the ingredients of Step B.

3. When the temperature reaches 140° F., slowly add the ingredients of Step C and mix for 10 minutes or until the soap is dissolved and the batch is uniform.

4. Add ingredients of Step D and mix for about 30 minutes or until the Sodium Cocoyl Isethionate goes into solution.

5. Discontinue mixing and let batch stand for a minimum of one hour. Ten minutes prior to the fill of the molds, add the fragrance and mix for 5 minutes.

Any desired amount of product can be made by increasing or decreasing the amounts of ingredients listed above, as long as the relative percentages are maintained. For example batches of 1000 lb. or more can be prepared. Further, an acceptable tint or dye may be added to give the soap a slight color or cast that does not interfere with the visualization of the printed logo.

Following the procedures of Example 1 will yield a liquefied translucent soap product with meets FDA requirements having a final formulation of the following Example 2:

EXAMPLE 2

| Ingredient | Quantity Range (% w/w) | Preferred Quantity (% w/w) |
|---|---|---|
| Propylene Glycol | 15 to 25 | 25.00 |
| Sorbitol | 15 to 25 | 18.03 |
| Water | 15 to 25 | 15.90 |
| Sodium Stearate | 10 to 20 | 14.95 |
| Sodium Lauryl Sulfate | 10 to 20 | 12.25 |
| Sodium Myristate | 2 to 6 | 7.12 |
| Sodium Cocoyl Isethionate | 2 to 6 | 5.00 |
| Triethanolamine | 0.5 to 3 | 1.00 |
| Fragrance | 0 to 2 | 0.75 |

Example 1 lists the raw ingredients before the chemical reaction that yields the product formulation of Example 2. For example, the stearic acid becomes sodium stearate upon chemical reaction with caustic soda. The water is provided through the raw ingredients. For example, both the sorbitol and sodium laureth sulfate contain 30% water and the caustic soda contains 50% water.

Although the formulation provided in Example 1has proved to work well for this application, it will be appreciated that any other formulation of soap that produces an acceptably transparent of translucent cake may be used without departing from the scope of the invention.

As stated above, bar 1 includes a printed sheet as indicated by reference numeral 5. As shown, sheet 5 bears a printed message 7 which, in the figures, for illustration only, is shown as the inventor's trademark. It will be appreciated that message 7 is intended to include any printed words, design, logo, picture, insignia, advertising copy, trademark, service mark, business name and so forth as desired. It also will be appreciated that the printed matter, referred to hereinafter as "message" for ease and clarity of description, can be printed or drawn onto the sheet in any desired color or pattern. The resulting message is viewable and/or readable through bar 3 without significant distortion.

Sheet 5 is provided in two embodiments. In either embodiment, the film is a substantially clear or transparent, generally colorless, printable synthetic polymer film. The film should be of an appropriate mil thickness to allow printing of a desired insignia, but is not so thick as to provide structural support for the soap bar itself. The first is a dissolvable, printable polymer film that can be printed with any desired insignia, the second is a readily dissolvable polymer film. In any event, in the preferred embodiment, the film is transparent and is printed on one side but is viewable through the film and soap. However, the film can be printed on both sides. The same message can be on both sides or two different messages may be used. It will be appreciated that sheet 5 can be provided as small printed sheets for introduction into bar 3. Further, sheet 5 can be provided on large sheets which are printed with discrete insignia and then cut into the smaller sheet 5 or can be provided on narrow rolls for introduction into bar 3. In any event, the sheet 5 is introduced into bar 3 in a manner as will be described in detail below.

When sheet 5 is dissolvable it is formed from a hot or cold water soluble, printable polymer film which is approximately 0.5 mil to 10 mil or more in thickness. Preferably the thickness is 1 to 5 mil, most preferably 1.5 to 3 mil. It will be appreciated that at the desired mil thickness, sheet 5 does not provide structural support for the soap bar. One such commercially available film is the QSA 2000 series of films (Polymer Films Inc., Rockville, Conn.). QSA 2000, for example, is a fast dissolving, hot and cold water soluble film based on polyvinyl alcohol. It is a colorless, transparent solution cast film which is resistant to the action of most organic and inorganic chemicals. It has excellent stability to UV light and gas barrier properties. The properties of the QSA 2000 film are listed below in Table 1.

TABLE 1

| Typical Properties | | Relative Humidity 40% | 60% | 80% |
|---|---|---|---|---|
| Tensile Strength, psi | Machine Direction | 5000 | 4800 | 4200 |
| ASTM D882 | Transverse Direction | 4900 | 4800 | 4700 |
| Elongation, % | Machine Direction | 350 | 330 | 350 |
| ASTM D882 | Transverse Direction | 330 | 330 | 350 |
| 100% Modulus, psi | Machine Direction | 2260 | 2100 | 1500 |
| ASTM D882 | Transverse Direction | 2300 | 2000 | 1600 |
| Toughness, in-lb/in$^3$ | Machine Direction | 10000 | 8900 | 7600 |
| ASTM D882 | Transverse Direction | 9500 | 8800 | 8300 |
| Tear Resistance, gr | Machine Direction | 1950 | 1800 | 1650 |
| ASTM D1922 | Transverse Direction | 2000 | 1900 | 1750 |

All data generated using 1.5 mil film after 24 hours conditioning at the various relative humidities.

The physical properties of the film are listed below in Table 2.

TABLE 2

| Physical Properties | |
|---|---|
| Melting Point | 200° C. (decomposes) |
| Specific Gravity | 1.27 |
| Water Vapor Transmission (gm/m$^2$/24 hr) | 1200 |

The specifications for the film are listed below in Table 3.

TABLE 3

| Specifications | |
|---|---|
| Film Thickness | 1.5 mil +/− 0.07<br>2.0 mil +/− 0.1 |
| Width | Slit to customer requirements up to 45 inches +/− 1/16 inch |
| Length | 4000 ft per roll of 1.5 mil film<br>3000 ft per roll of 2.0 mil film |
| Yield | for 1.5 mil film 15,000 m$^2$/lb<br>for 2.0 mil film 11,250 m$^2$/lb |

Figure 4:
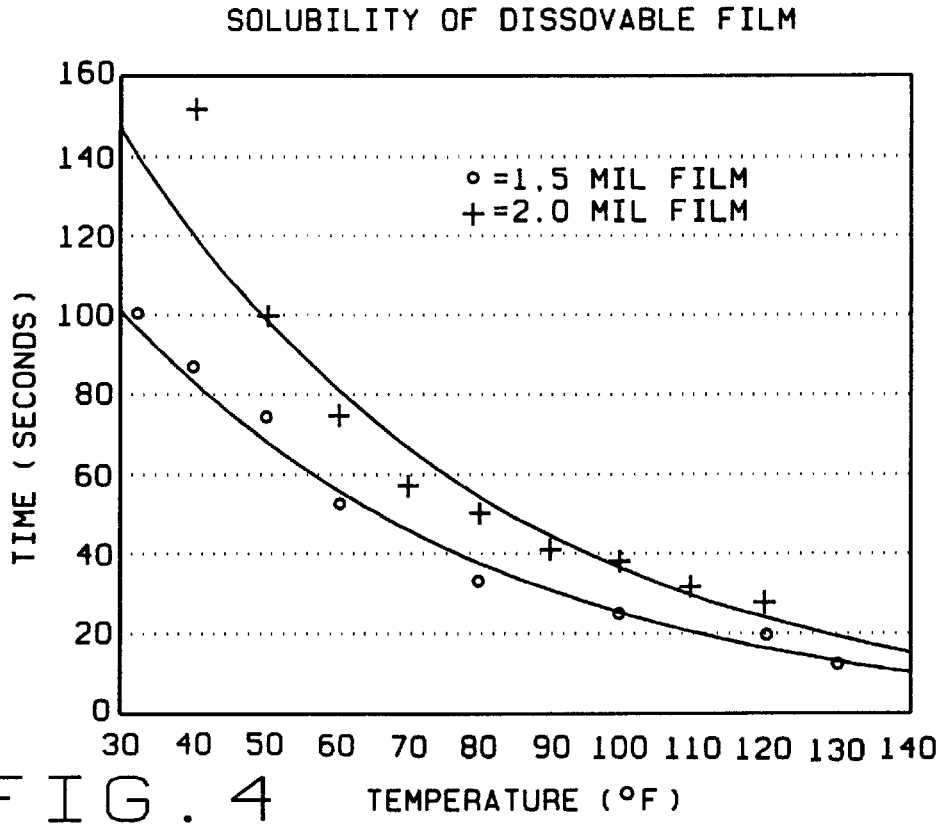
FIG. 4 is graph illustrating the solubility of one dissolvable embodiment of, printed film.

The QSA 2000 film has a solubility range of 32 to 212° F. but dissolves more quickly in hot water as shown in FIG. 4. As shown in FIG. 4, both 1.5 mil film and 2.0 mil film disintegrate more rapidly as the temperature rises from 30° to 140°. This is of importance to the present invention since it is one object of the present invention to provide a printed film at the center of the bar that will dissolve upon normal use when the bar is used up to the point that the printed film is exposed to warm water. Because the printed film readily dissolves, the printed film does not create a disposal problem and will not block or clog drains or require removal.

The polymer film can be machined, formed and printed using standard industry equipment and is readily printable on commercial printing equipment using water soluble inks. Although the QSA 2000 polymer film described above has proved to function well in this application, any such dissolvable, printable film can be used without departing from the scope of the invention. Furthermore, although the embodiment of the dissolvable printable film described above has a thickness of 1 mil to 3 ml, it will be understood that any thickness of film, from 0.5 mil to 10 mil or more that exhibits the desired dissolution characteristics.

In another preferred embodiment, sheet 5 is not readily dissolvable. Sheet 5 is formed from a synthetic polymer film in a thickness of 0.5 mil to 10 mil, preferably 3 mil to 8 mil. One example of an acceptable printable film is a highly plasticized, clear cling vinyl film provided on a carrier sheet (FLEXMARK®, CV; FLEXCON, Spencer, Mass.). The film itself can be printed and then pulled free from the carrier sheet and introduced into the bar as provided below. Generally, the plastic film is colorless. It will be appreciated that the foregoing film is intended as an example of an acceptable, not readily dissolvable printable thin, flexible, clear, colorless plastic film. Any such film in other appropriate mil thicknesses provided by other manufacturers that is clear or transparent, colorless, printable and non-supportive, is intended to be encompassed by the appended claims. It will be appreciated that the preferred thicknesses of non-dissolvable films provide an insert which is readily printable but does not function to support the bar of soap. Furthermore, such a thin, flexible, non-dissolvable layer does not present a significant health or safety hazard.

Figure 5:
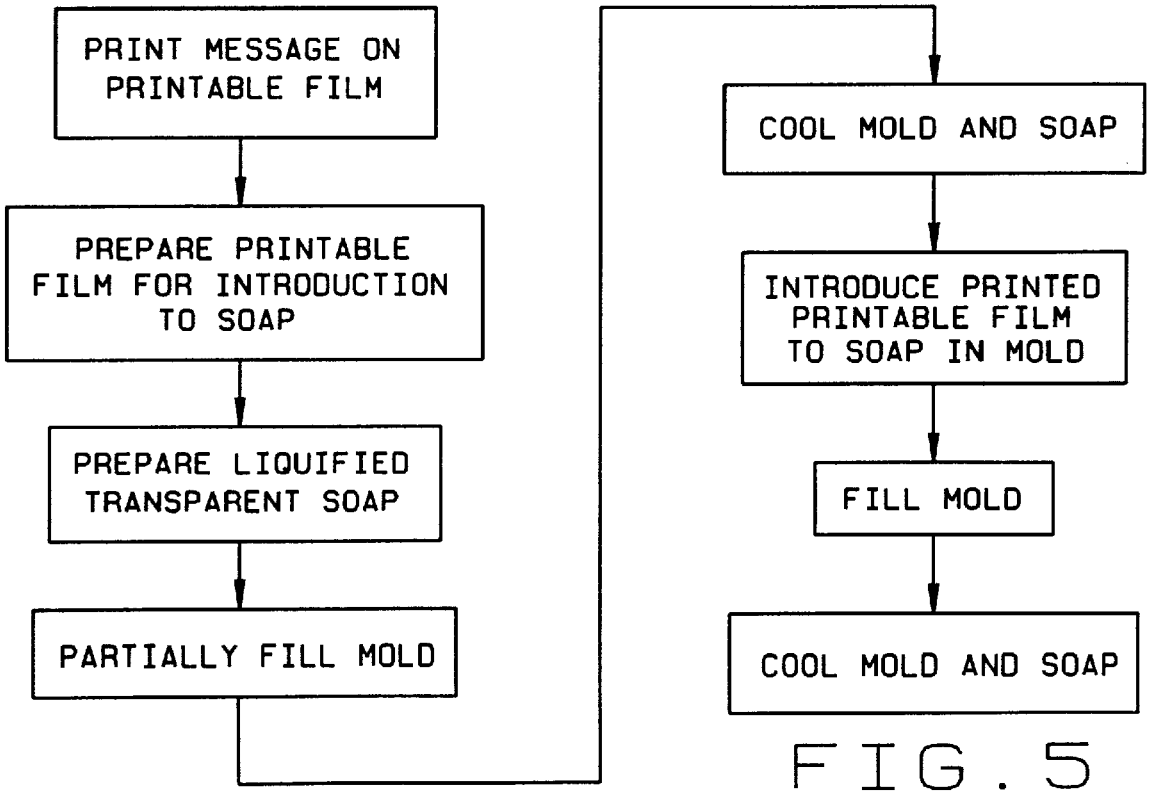
FIG. 5 is a block diagram illustrating the method of making the novel cleansing bar bearing the printed film.

The bar 1 is produced in accordance with the steps provided in FIG. 5. First, the polymer film is printed with the desired logo, design or message. As stated above, the film can be printed on large sheets or rolls, as desired. The film can be provided on a carrier, as stated above. The individual sheets 5 then are prepared by cutting into a plurality of individual sheets 5 from the larger sheet or from the roll. Next, a batch of soap product to form the bar 3 is prepared according to procedures provided in Example 1. Next a mold is placed onto a moving conveyor belt. The mold is designed to produce any desired configuration of soap cake, as discussed above. The mold can be a polyvinyl clam sell mold or a multi-cavity tray made from a silicone compound. The molds travels down the conveyer and trigger a conventional filling mechanism. A piston liquid filler then dispenses a small, predetermined amount of liquid hot soap into the mold to partially or half fill the mold. The mold then travels through a cooling tunnel and exits at the opposite end of the conveyor line where it is placed on a return conveyor which returns it to the front of the line. The partially filled mold then is placed onto the conveyor for a second pass. If the printed sheets 5 are provided on a carrier, they first are removed or pulled off the carrier sheet. The printed sheets 5 are placed onto the cooled soap in the mold, generally by hand, and lightly rubbed down. The mold then moves on the conveyor and triggers the filling mechanism so that a remaining, predetermined amount of liquid soap is introduced into the mold, encasing sheet 5. The mold once again moves through the cooling tunnel and exists at the opposite end of the line for packaging.

It will be appreciated that the above procedure produces a bar 1 which has a non-supporting, clear, colorless printed film at the approximate midpoint of the bar. Any message or design printed on the film is readable or viewable without distortion through the transparent bar. It also will be appreciated that the foregoing method of manufacturing bar 1 is the best mode of manufacturing presently known to the inventor. However, it will be appreciated that bar 1 of the present invention, as described and claimed, can be manufactured by any acceptable process that provides for a transparent cake of soap having a printed logo at the approximate midpoint of the cake without departing from scope of the invention.

It also will be appreciated that the changes or modifications can be made in the soap formulation or the choice of printable film without departing from the scope of the appended claims. In view of the above, it will be seen that the several objects and advantages of the present invention have been achieved and other advantageous results have been obtained. Therefore, the foregoing descriptions and accompanying drawings are intended to be illustrative only, and should not be construed in a limiting sense.

What is claimed is:

1. In a transparent cleansing product formed into a cake, the improvement comprising:

a colorless and transparent non-supportive and non-dissolvable synthetic polymer film located within the transparent cake such that substantial portions of the cake are positioned on each side of said synthetic polymer film, printed matter on at least one side of the synthetic polymer film, said synthetic polymer film having a predetermined thickness which, together with its transparency, is not independently viewable in the transparent cake, and said printed matter being viewable through the transparent cake and being the only element that is viewable and not transparent.

2. A cleansing bar comprising, in combination, a transparent cake of cleansing material and a thin and non-supportive colorless and transparent non-dissolvable synthetic polymer film located within the transparent cake such that substantial portions of the transparent cake are positioned on each side of the synthetic polymer film, said synthetic polymer film having an predetermined thickness which, together with its transparency, is not independently viewable in the transparent cake, said synthetic polymer film bearing a printed indicia and comprising the only element within the transparent cake that is viewable and not transparent.

3. The cleansing bar as defined in claim 2 in which the synthetic polymer film has a thickness in the range from 0.5 mil to 10 mil.

* * * * *